US012043945B2

(12) United States Patent
Meurer et al.

(10) Patent No.: US 12,043,945 B2
(45) Date of Patent: Jul. 23, 2024

(54) INTEGRATED COLLAPSIBLE PLATFORM FOR A DOMESTIC APPLIANCE

(71) Applicant: Haier US Appliance Solutions, Inc., Wilmington, DE (US)

(72) Inventors: Jason Meurer, Louisville, KY (US); James Augustine Ford, Fisherville, KY (US); Stephen Edward Hettinger, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 236 days.

(21) Appl. No.: 17/569,704

(22) Filed: Jan. 6, 2022

(65) Prior Publication Data

US 2023/0212810 A1 Jul. 6, 2023

(51) Int. Cl.
*D06F 39/12* (2006.01)

(52) U.S. Cl.
CPC ..... *D06F 39/12* (2013.01)

(58) Field of Classification Search
CPC ..... D06F 39/12; D06F 39/125
USPC ..... 312/309, 313, 314
See application file for complete search history.

(56) References Cited

U.S. PATENT DOCUMENTS 6,036,150 A * 3/2000 Lehrman ..... D06F 39/12 211/186
10,260,189 B2 * 4/2019 Underly ..... D06F 81/06
10,717,456 B2 * 7/2020 Shrago ..... B62B 5/087
11,408,225 B1 * 8/2022 Godfrey ..... E06C 1/005
2004/0245899 A1 * 12/2004 Cho ..... A47B 91/005 312/351.2
2006/0119237 A1 * 6/2006 Packer ..... A47B 46/005 312/313
2008/0282748 A1 * 11/2008 Carver ..... A47B 35/00 108/127
2009/0293553 A1 * 12/2009 Kendall ..... D06F 43/081 68/13 R
2017/0188702 A1 * 7/2017 Petrizzi ..... D06F 39/14
2018/0148884 A1 * 5/2018 Ciulla, Jr. ..... D06F 95/00
2019/0368098 A1 * 12/2019 Lv ..... D06F 81/04
2023/0101062 A1 * 3/2023 Bailey ..... A47B 46/00 211/195

FOREIGN PATENT DOCUMENTS

DE 202005014026 U1 11/2005
EP 2063014 A2 * 5/2009 ..... D06F 29/00
FR 3065233 B1 3/2020
JP H11146995 A 6/1999
WO WO2016155801 A1 10/2016

* cited by examiner

*Primary Examiner* — Daniel J Rohrhoff
(74) *Attorney, Agent, or Firm* — Dority & Manning, P.A.

(57) ABSTRACT

An articulating platform assembly for a home appliance includes a bracket selectively coupled to a cabinet support structure of the home appliance, a first platform support structure extending from the bracket along the vertical direction, a platform base rotatably coupled to the first platform support structure, wherein the platform base pivots with respect to the first platform support structure between an open position and a closed position; and a second platform support structure pivotally attached to the platform base opposite the first platform support structure, the second platform support structure being movable between a first position and a second position.

17 Claims, 6 Drawing Sheets

INTEGRATED COLLAPSIBLE PLATFORM FOR A DOMESTIC APPLIANCE

FIELD OF THE INVENTION

The present subject matter relates generally to domestic appliances, and more particularly to accessories for laundry treatment appliances.

BACKGROUND OF THE INVENTION

Certain domestic or household appliances, such as laundry treatment appliances (washing machines, dryers, combination machines) perform automatic tasks such as washing and drying for the convenience of users. In particular, laundry appliances receive laundry loads within a basket to which water and detergent are supplied to perform a washing operation. Some laundry appliances are classified as vertical axis laundry appliances. These vertical axis laundry appliances include baskets that are configured to rotate about a vertically oriented axis. For vertically oriented axis machines, access to the basket is located at the top of the laundry appliance. Accordingly, these laundry machines may also be referred to as top load laundry appliances.

Recently, domestic laundry appliances have been increasing in size, particularly volume, so as to handle larger laundry loads. This increase in size has subsequently elevated a top of the laundry appliance significantly, resulting in the bottom of the basket being located deeper into a cabinet of the appliance. As a result, it can be difficult for users of the laundry appliances to reach into the basket to retrieve laundry items from the bottom. Moreover, the height of recent laundry appliances can make it difficult for users to place items from a laundry basket into the wash basket, or vice versa.

Accordingly, a domestic appliance that obviates one or more of the above-mentioned features would be beneficial. In particular, a laundry treatment appliance or accessory for a laundry treatment appliance that improves a usability of the appliance would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a domestic appliance is provided. The domestic appliance may include a cabinet defining a receiving space, including a floor; a bracket selectively coupled to the cabinet; and an articulating platform assembly selectively coupled to the cabinet, the articulating platform assembly being movable between an open position and a closed position. The articulating platform assembly may include a platform base; a rear platform support structure attached to each of the platform base and the bracket, wherein the platform base pivots with respect to the rear platform support structure; and a front platform support structure pivotally attached to the platform base opposite the rear platform support structure, the front platform support structure being movable between a first position and a second position.

In another exemplary aspect of the present disclosure, an articulating platform assembly for a home appliance is provided. The articulating platform assembly may be attachable to a cabinet of the home appliance, and may include a bracket selectively coupled to the cabinet; a rear platform support structure extending from the bracket along the vertical direction; a platform base rotatably coupled to the rear platform support structure, wherein the platform base pivots with respect to the rear platform support structure between an open position and a closed position; and a front platform support structure pivotally attached to the platform base opposite the rear platform support structure, the front platform support structure being movable between a first position and a second position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
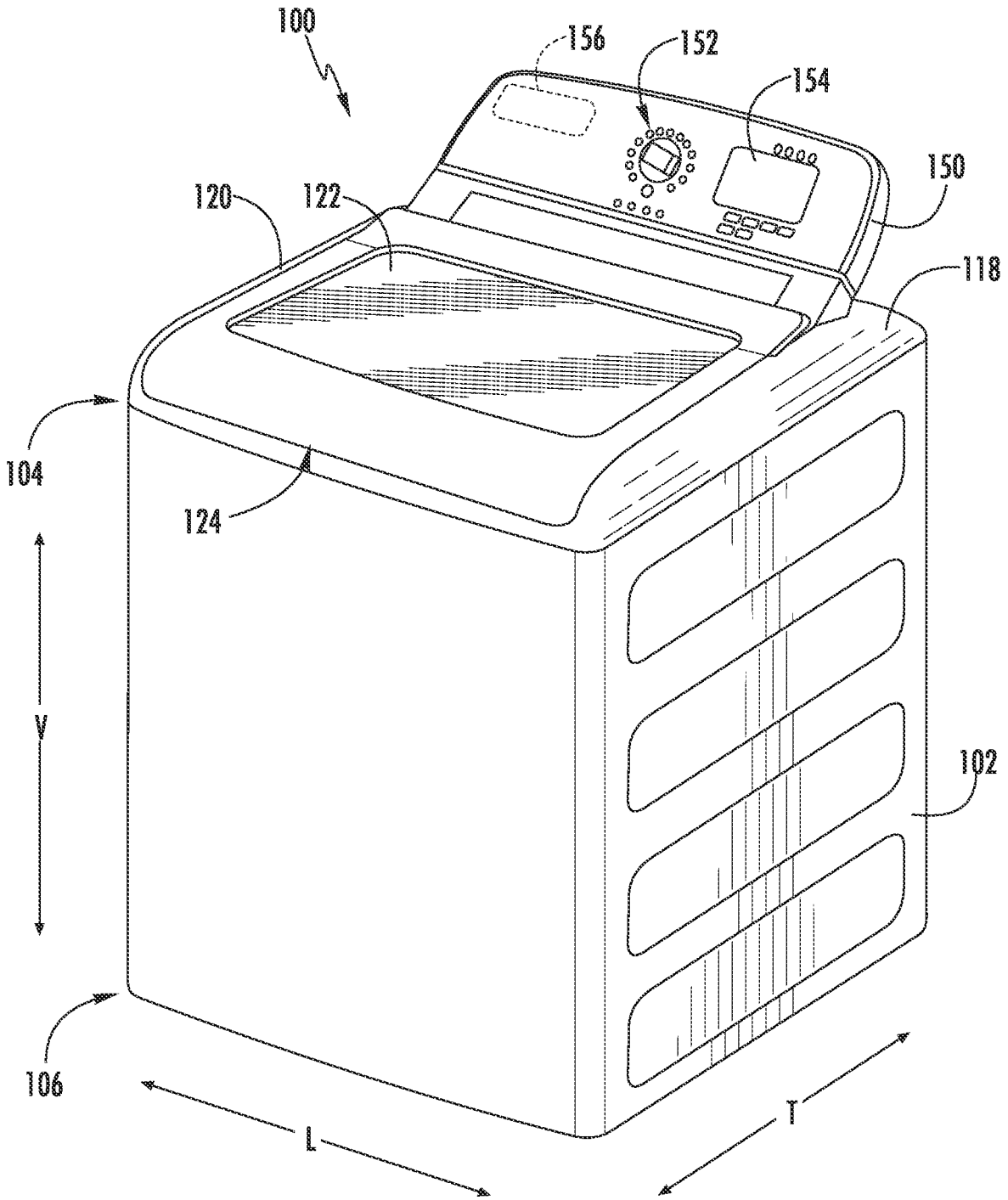
FIG. 1 provides a perspective view of a laundry machine appliance with a lid in a closed position according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
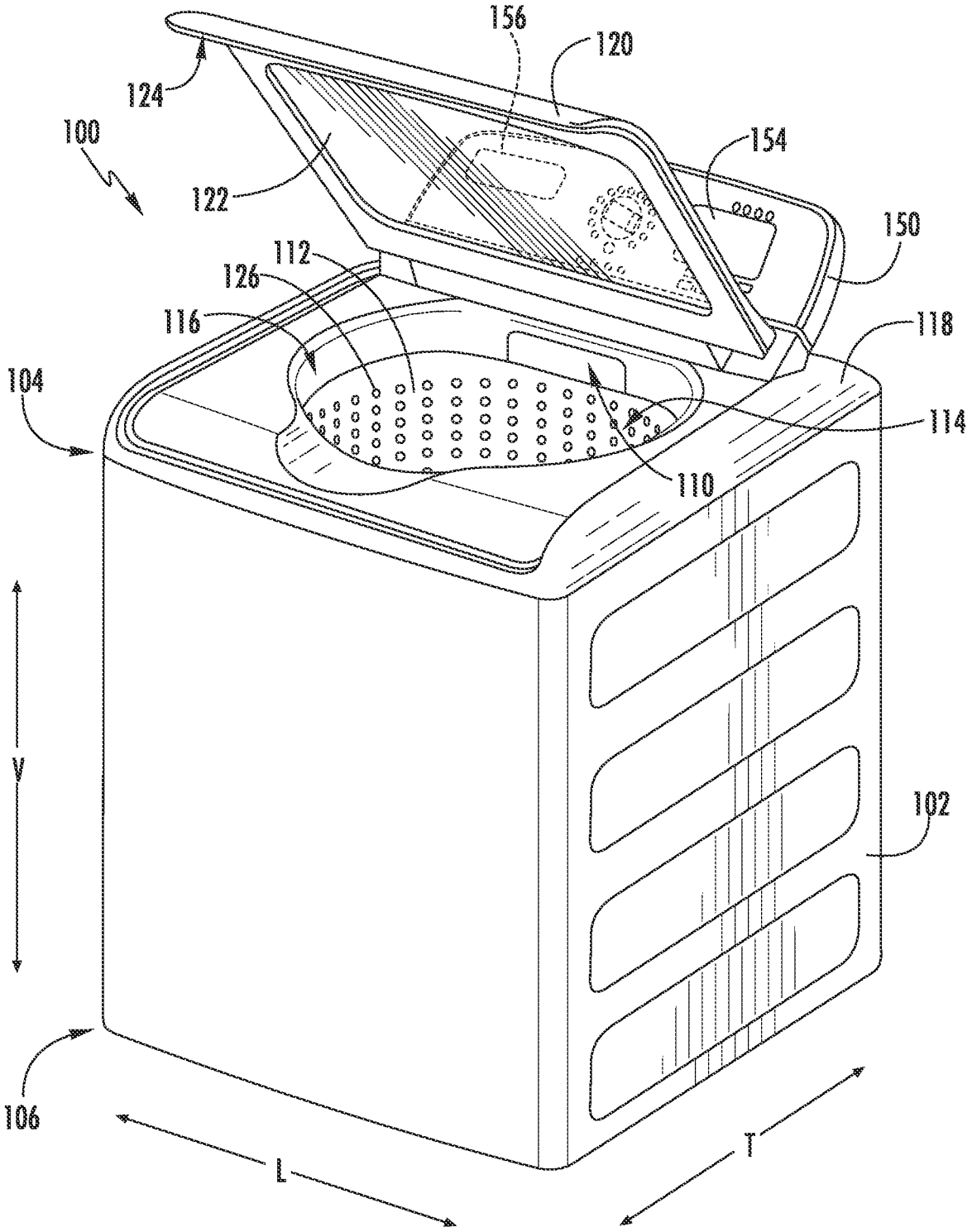
FIG. 2 provides a perspective view of the exemplary laundry machine appliance of FIG. 1 with the lid in an open position.

FIGS. 1 and 2 illustrate an exemplary embodiment of a vertical axis laundry machine appliance or washing machine 100. Specifically, FIGS. 1 and 2 illustrate perspective views of laundry machine appliance 100 in a closed and an open position, respectively. Laundry machine appliance 100 generally defines a vertical direction V, a lateral direction L, and a transverse direction T, each of which is mutually perpendicular, such that an orthogonal coordinate system is generally defined.

While described in the context of a specific embodiment of a vertical axis laundry machine, it should be appreciated that vertical axis laundry machine appliance 100 is provided by way of example only. It will be understood that aspects of the present subject matter may be used in any other suitable laundry machine appliance, such as a horizontal axis laundry machine appliance. Moreover, it will be understood that aspects of the present subject matter may be used in other suitable home appliances that may require a boost for a user, such as a freezer chest. Indeed, modifications and variations may be made to appliance 100, including different configurations, different appearances, and/or different features while remaining within the scope of the present subject matter. For instance, laundry machine appliance 100 may be a combination washing machine and dryer appliance.

Figure 3:
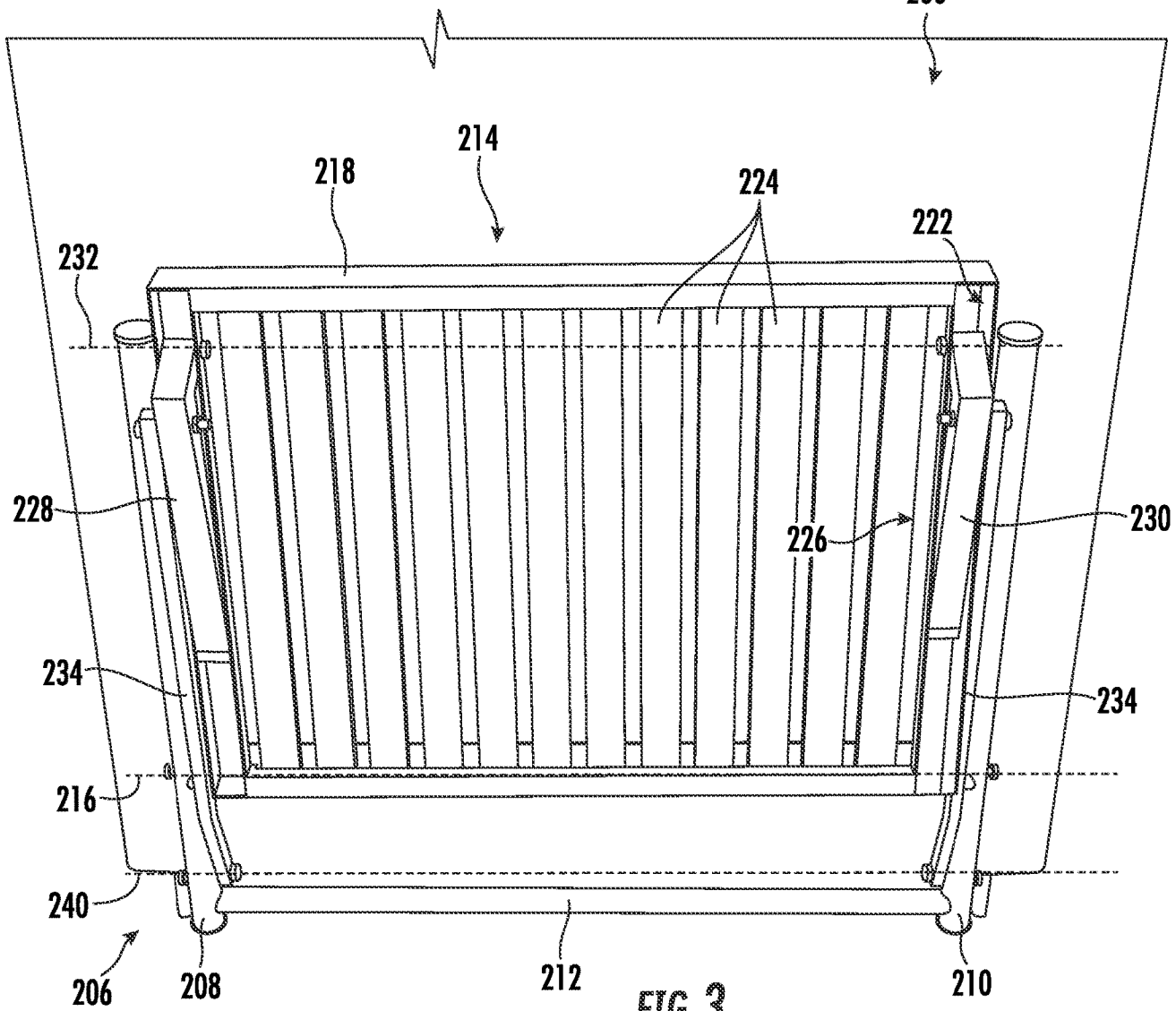
FIG. 3 provides a front view of the exemplary laundry machine appliance of FIG. 1 with an articulating platform assembly attached thereto in a closed position.

Laundry machine appliance 100 has a cabinet 102 that extends between a top portion 104 and a bottom portion 106 along the vertical direction V. As best shown in FIG. 3, cabinet 102 may form a receiving space in which a tub 108 is positioned. Tub 108 may be generally configured for retaining wash fluids during an operating cycle (e.g., a washing cycle). Laundry machine appliance 100 further includes a primary dispenser 110 (FIG. 2) for dispensing wash fluid into tub 108. The term "wash fluid" refers to a liquid used for washing and/or rinsing articles during an operating cycle and may include any combination of water, detergent, fabric softener, bleach, and other wash additives or treatments.

In addition, laundry machine appliance 100 includes a drum 112 that is positioned within tub 108 and generally defines a wash chamber 114 including an opening 116 for receipt of articles for washing. More specifically, drum 112 may be rotatably mounted within tub 108 such that it is rotatable about an axis of rotation A. According to the illustrated embodiment, the axis of rotation A is substantially parallel to the vertical direction V. In this regard, laundry machine appliance 100 is generally referred to as a "vertical axis" or "top load" laundry machine appliance 100. However, as noted above, it should be appreciated that aspects of the present subject matter may be used within the context of a horizontal axis or front load laundry machine appliance as well.

As illustrated, cabinet 102 of laundry machine appliance 100 has a top panel 118. Top panel 118 defines an opening (FIG. 2) that coincides with opening 116 of wash basket 112 to permit a user access to wash basket 112. Laundry machine appliance 100 further includes a door or lid 120 which is rotatably mounted to top panel 118 to permit selective access to opening 116. In particular, lid 120 selectively rotates between the closed position (as shown in FIGS. 1 and 3) and the open position (as shown in FIG. 2). In the closed position, lid 120 inhibits access to wash basket 112. Conversely, in the open position, a user can access wash basket 112. A window 122 in lid 120 permits viewing of wash basket 112 when lid 120 is in the closed position, e.g., during operation of laundry machine appliance 100. Lid 120 also includes a handle 124 that, e.g., a user may pull and/or lift when opening and closing lid 120. Further, although lid 120 is illustrated as mounted to top panel 118, lid 120 may alternatively be mounted to cabinet 102 or any other suitable support.

As best shown in FIG. 2, wash basket 112 further defines a plurality of perforations 126 to facilitate fluid communication between an interior of wash basket 112 and tub 108. In this regard, wash basket 112 is spaced apart from tub 108 to define a space for wash fluid to escape wash chamber 114. During a spin cycle, wash fluid within articles of clothing and within wash chamber 114 is urged through perforations 126 wherein it may collect in a sump defined by tub 108. Laundry machine appliance 100 may further include a pump assembly that is located beneath tub 108 and wash basket 112 for gravity assisted flow when draining tub 108, e.g., after a wash or rinse cycle.

Figure 4:
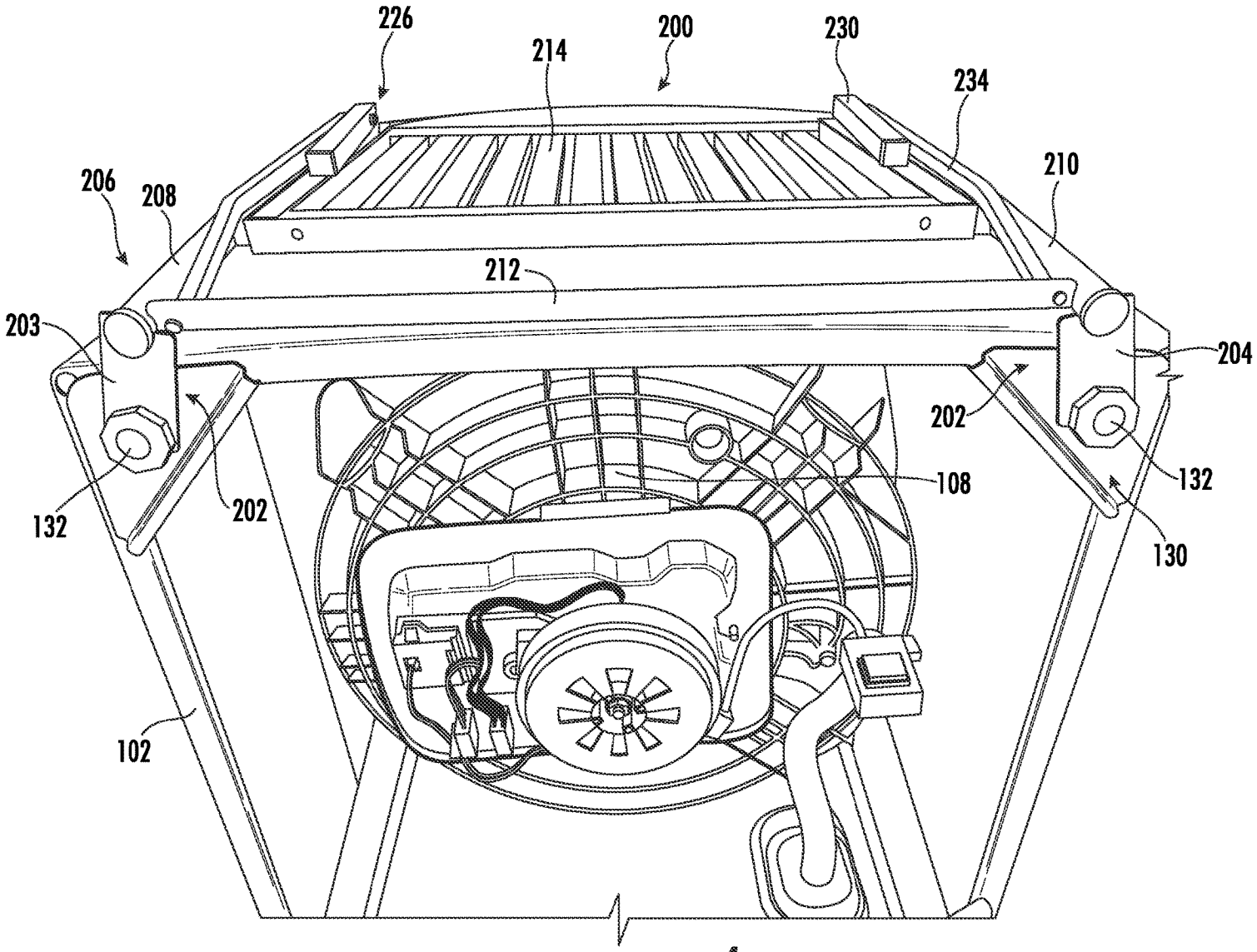
FIG. 4 provides a bottom perspective view of the exemplary laundry machine appliance of FIG. 1 including the articulating platform assembly.

Referring briefly to FIG. 4, cabinet 102 may include a cabinet support structure 130. For instance, cabinet support structure 130 may support bottom 106 of cabinet 102 (e.g., on a ground or floor). Cabinet support structure 130 may include one or more cabinet legs 132. For instance, cabinet support structure 130 may include a pair of front cabinet legs 132. The pair of front cabinet legs 132 may be spaced apart from each other, e.g., along the transverse direction T. Accordingly, a first front cabinet leg 132 may be provided at a front left side of cabinet 102 and a second front cabinet leg 132 may be provided at a front left side of cabinet 102. Cabinet support structure 130 may be adjustable along the vertical direction V. For instance, the pair of front cabinet legs 132 may be rotatable installed to cabinet 102. Accordingly, a user may rotate each front cabinet leg independently to raise or lower a height of washing machine appliance 100 with respect to the ground or floor. Additionally or alternatively, each of the pair of front cabinet legs 132 may be rotated individually, e.g., to properly level washing machine appliance 100 with respect to an uneven surface.

Figure 5:
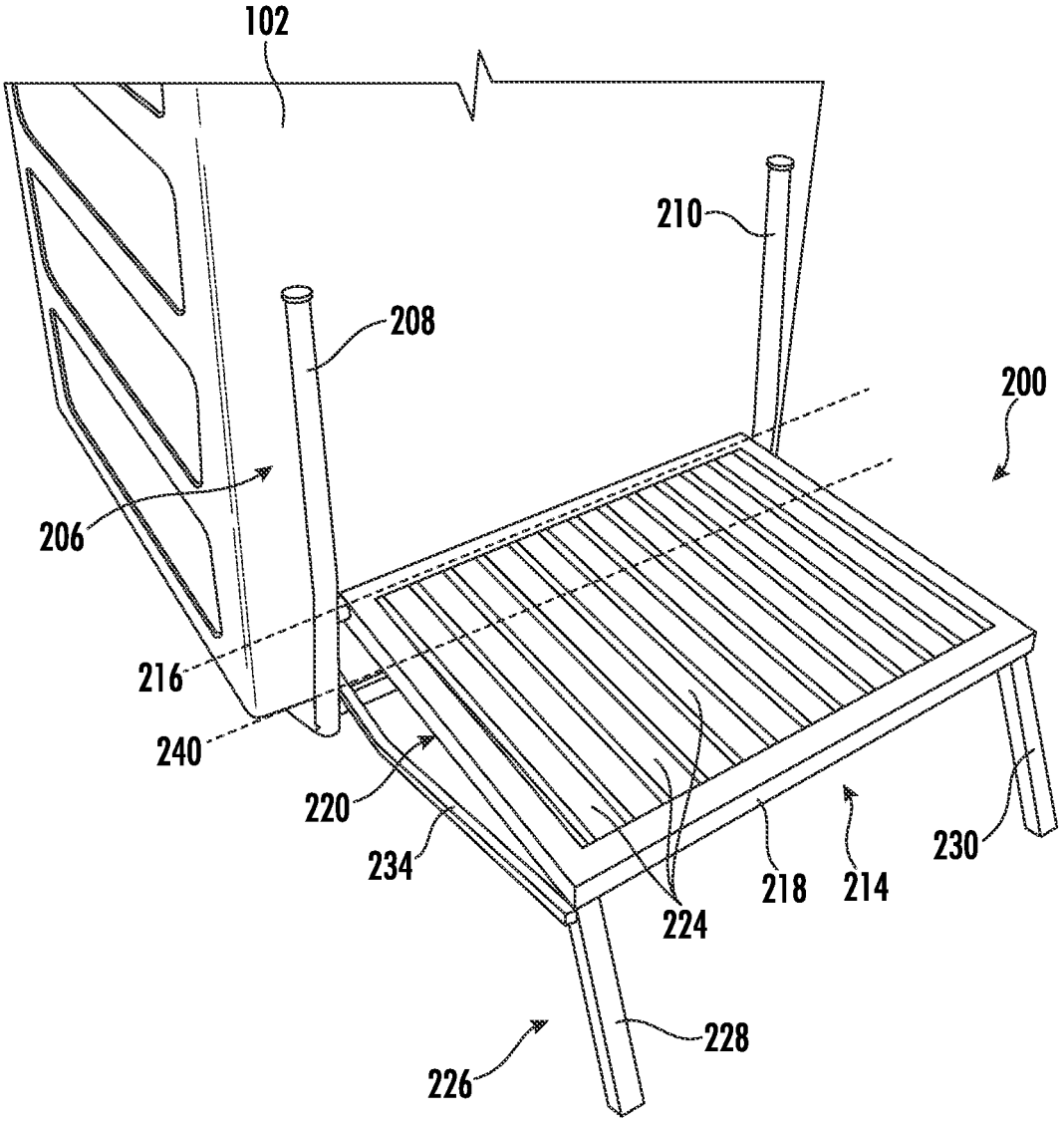
FIG. 5 provides a perspective view of the exemplary laundry machine appliance of FIG. 1 with the articulating platform assembly in an open position.
Figure 6:
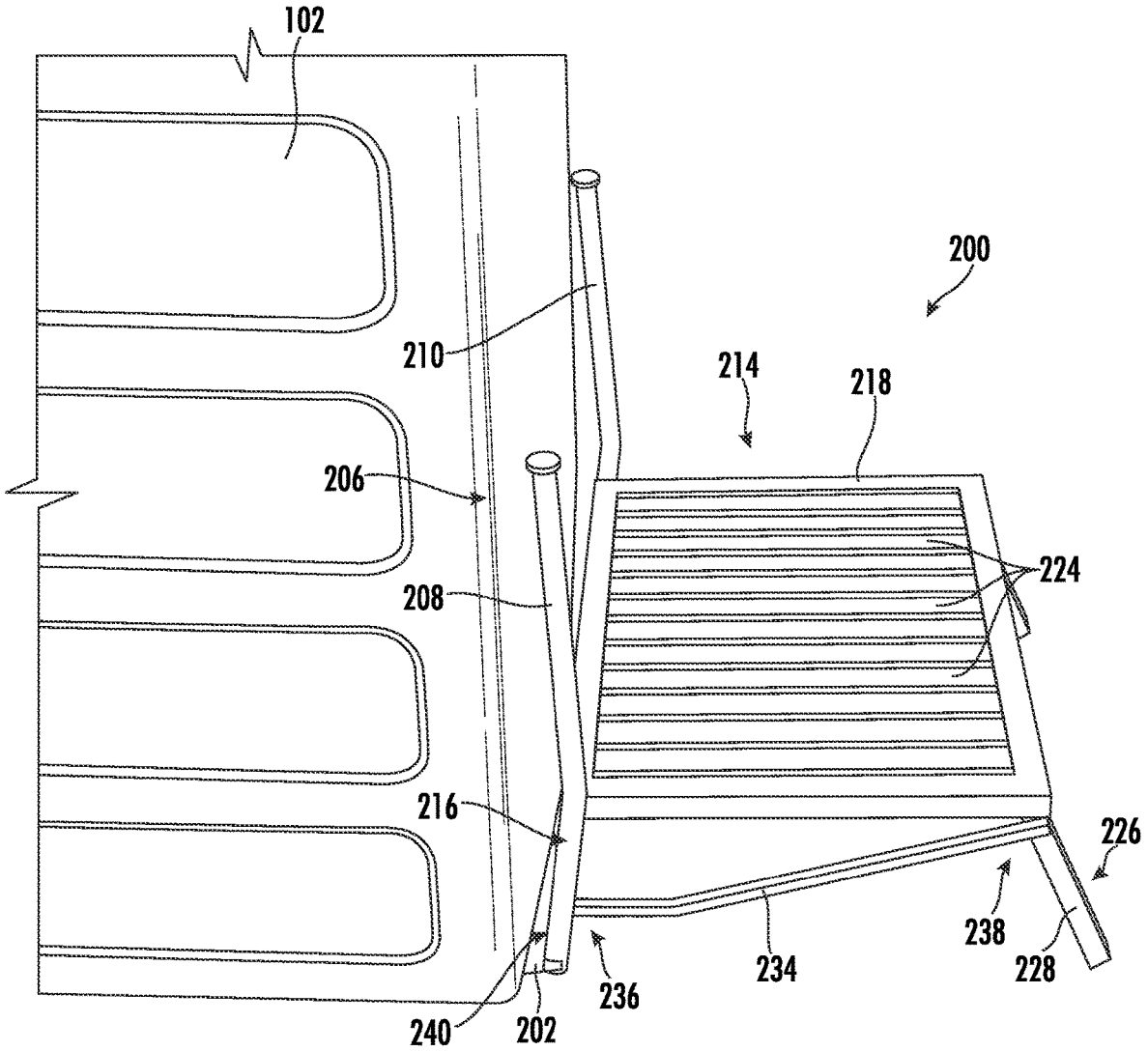
FIG. 6 provides a side perspective view of the exemplary laundry machine appliance of FIG. 1 with the articulating platform assembly in an open position.

FIGS. 3 through 6 illustrate an articulating (or collapsible) platform assembly 200 which may be selectively coupled to, for example, cabinet 102 of washing machine appliance 100. Platform assembly 200 may be movable between a closed position (e.g., as shown in FIGS. 3 and 4) and an open position (e.g., as shown in FIGS. 5 and 6). When in the closed position, platform assembly 200 may fold up against an outer wall of cabinet 102. In at least one example, platform assembly 200 folds up against a front wall of cabinet 102. When in the open position, platform assembly 200 may provide an elevated (e.g., relative to ground level) surface, on which a user may place a laundry basket or hamper, or on which a user may stand to gain access to a bottom of drum 112. The construction and operation of platform assembly 200 will be described in detail herein.

Platform assembly 200 may be connected to cabinet via a bracket 202. For instance, bracket 202 may be selectively coupled to cabinet support structure 130. In some embodiments, bracket 202 is coupled directly to cabinet 102. Further still, platform assembly 200 may be connected directly to cabinet 102 (or cabinet support structure 130) without bracket 202. It should be understood that the disclosure is not limited to the examples given herein, and that any suitable connection between platform assembly 200 and cabinet 102 may be utilized.

With reference to FIG. 4, bracket 202 may include two separate brackets, each being attached to a respective front cabinet leg 132. For instance, a first bracket 203 may be attached to a first cabinet leg 132 (e.g., the front left cabinet leg) while a second bracket 204 may be attached to a second cabinet leg 132 (e.g., the front right cabinet leg). Advantageously, each of first bracket 203 and second bracket 204 may rotate about the respective front cabinet leg 132. Accordingly, platform assembly 200 may be attached to a plurality of washing machine appliances, for instance, having different widths along the lateral direction L. In detail, cabinet support structure 130 (e.g., front cabinet legs 132) may penetrate bracket 202 (or first and second brackets 203, 204). Thus, bracket 202 may be coupled to cabinet support structure 130 via a leg nut or other suitable connector.

Moreover, bracket 202 may extend out from bottom 106 of cabinet 102, e.g., along the transverse direction T. This is merely an example, however, and according to alternate embodiments, bracket 202 may extend along the lateral direction L (i.e., if positioned along a side of cabinet 102). Bracket 202 (e.g., first and second brackets 203, 204) may include connection means at a distal end thereof (e.g., distal to cabinet 102 along the transverse direction). Bracket 202 may thus selectively couple to platform assembly 200 via the connection means. The connection means may include one or more of connection holes, clamps, magnets, fasteners, adhesives, or any suitable connector that selectively couples bracket 202 to platform assembly 200.

For instance, platform assembly 200 may include a rear platform support structure 206. Rear platform support structure 206 may support platform assembly 200 with respect to the floor or ground (e.g., on which washing machine appliance 100 rests). As such, rear platform support structure 206 may include a pair of rear platform legs including a first rear platform leg 208 and a second rear platform leg 210. The pair of rear platform legs 208, 210 may extend generally along the vertical direction (e.g., predominantly parallel to a front face of cabinet 102). Each of first rear platform leg 208 and second rear platform leg 210 may selectively couple to bracket 202 (e.g., first bracket 203 and second bracket 204), via the connection means. According to some embodiments, first rear platform leg 208 may penetrate through first bracket 203 and second rear platform leg 210 may penetrate through second bracket 204. Accordingly, rear platform support structure 206 may be coupled to cabinet 102 (e.g., via bracket 202).

Rear platform support structure 206 may include a lateral cross member 212. Lateral cross member 212 may connect first rear platform leg 208 and second rear platform leg 210 to each other. In some embodiments, lateral cross member 212 is provided at or near a bottom of rear platform support structure 206. However, a specific positioning of lateral cross member 212 may vary according to specific embodiments. Generally, lateral cross member 212 may be provided below a platform pivot point (described below) of platform assembly 200, so as to minimize potential interference and ensure a proper and secure fit (e.g., when platform assembly 200 is in the closed position).

Platform assembly 200 may include a platform base 214. Platform base 214 may be pivotally or rotatably connected to rear platform support structure 206. For instance, platform base 214 may be positioned between first rear platform leg 208 and second rear platform leg 210. As shown particularly in FIG. 3, platform base 214 may selectively rotate or pivot with respect to rear platform support structure 206. As shown in FIG. 3, platform base 214 is in the closed position. Platform base 214 may rotate about a rear platform pivot axis 216. Accordingly, when a user wishes to move platform assembly 200 (e.g., platform base 214) from the closed position to the open position, the platform base 214 may be rotated about rear platform pivot axis 216 (e.g., away from cabinet 102.

Platform base 214 may include a frame member 218. Frame member 218 may define an outer periphery of platform base 214. For instance, frame member 218 may be a metal piece formed in a prescribed shape (e.g., as shown in FIG. 3, a rectangle). Platform base 214 may thus define an outer edge 220 and an inner edge 222. Rear platform support structure 206 may be attached to outer edge 220 of platform base 214. Accordingly, when platform assembly 200 is in the closed position, platform base 214 may be positioned between first rear platform leg 208 and second rear platform leg 210. Moreover, platform pivot axis 216 may be defined through first rear platform leg 208, frame member 218, and second rear platform leg 210.

Platform base 214 may include a plurality of slats 224 arranged within frame member 218. For instance, the plurality of slats 224 may extend between a front of frame member 218 and a rear of frame member 218. Additionally or alternatively, the plurality of slats 224 may extend between a first lateral side and a second lateral side of frame member 218. Thus, the plurality of slats 224 may form a surface on which a user may stand or place items, such as a laundry basket or hamper. The plurality of slats 224 may be spaced apart from each other, e.g., according to a regular interval. Thus, water (e.g., from tub 108) may not collect on or within platform base 214. Additionally or alternatively, each of the plurality of slats 224 may include one or more coatings or adhesives. For example, a grip tape or rough coating may be applied to each of the plurality of slats 224. The coating or adhesive may include one or more different coatings and/or adhesives, which may improve grip for a user or an item placed on platform base 214.

Platform assembly 200 may include a front platform support structure 226. Front platform support structure 226 may be rotatably or pivotally attached to platform base 214. In detail, front platform support structure 226 may selectively rotate or pivot with respect to platform base 214. Front platform support structure 226 may thus be movable between a first position and a second position. In at least some embodiments, the first position corresponds to the closed position of platform assembly 200 (FIGS. 3 and 4). Accordingly, the second position may correspond to the open position of platform assembly 200 (FIGS. 5 and 6).

Front platform support structure 226 may include a pair of front platform legs, including a first front platform leg 228 and a second front platform leg 230. Each of first front platform leg 228 and second front platform leg 230 may rotate or pivot about a front platform pivot axis 232. In at least some embodiments, first front platform leg 228 pivots independently from second front platform leg 230. In detail, no cross member may be provided to connect the pair of front platform legs. However, as will be described in more detail below, a kinematic structure may ensure that each of first front platform leg 228 and second front platform leg 230 rotate or pivot together when platform assembly 200 is moved from the closed position to the open position, and vice versa.

Each of first front platform leg 228 and second front platform leg 230 may extend predominantly along the vertical direction V (e.g., at least when platform assembly 200 is in the open position). Thus, together with rear platform assembly 206, front platform assembly 226 may stably support platform base 214. In some embodiments, each of first front platform leg 228 and second front platform leg 230 include one or more bends, for instance, forming an "L" shape. The specific shape of each of first front platform leg 228 and second front platform leg 230 may vary according to specific embodiments, however.

Moreover, each of the pair of front platform legs may be attached to inner edge 222 of frame member 218. In detail, first front platform leg 228 and second front platform leg 230 may be attached to an interior of frame member 218. As shown particularly in FIG. 3, first front platform leg 228 and second front platform leg 230 may be sandwiched within frame member 218. Additionally or alternatively, front platform support structure 226 (e.g., first front platform leg 228 and second front platform leg 230) may be positioned inside of rear platform support structure 206 (e.g., first rear platform leg 208 and second rear platform leg 210). Advantageously, when platform assembly 200 is in the closed position, front platform support structure 226 does not interfere with rear platform support structure 206. Accordingly, a more streamlined profile of platform assembly 200 may be achieved.

Platform assembly 200 may include a kinematic structure coupled between rear platform support structure 206 and front platform support structure 226. In detail, a bar 234 may connect, for example, first rear platform leg 208 and first front platform leg 228. Bar 234 may extend predominantly along the transverse direction T (e.g., when platform assembly 200 is in the open position, as shown in FIGS. 5 and 6). In some embodiments, bar 234 includes one or more bends, e.g., along the vertical direction V. A specific shape of bar 234 may vary according to specific embodiments, and the disclosure is not limited to the examples given herein. For instance, the shape of bar 234 may reduce interference between rear platform support structure 206, platform base 214, and/or bar 234 itself.

A proximate end 236 of bar 234 may be pivotally connected to first rear platform leg 208. Similarly, a second bar 234 may be pivotally connected to second rear platform leg 210. Proximate end 236 may allow bar 234 to rotate or pivot about a bar pivot axis 240. According to some embodiments, bar pivot axis 240 is provided below rear platform pivot axis 216 (e.g., along the vertical direction V).

A distal end 238 of bar 234 may be rotatably or pivotally connected to front platform support structure 226 (e.g., first front platform leg 228). In some embodiments, distal end 238 is provided adjacent to front platform pivot axis 232. Accordingly, when platform assembly 200 is moved from the closed position to the open position (or vice versa) bar 234 may simultaneously rotate front platform support structure 226 from the first position to the second position (or vice versa).

Platform assembly 200 may include one or more features which may assist in moving, rotating, or pivoting platform assembly 200 between the closed position and the open position, and vice versa. For instance, a soft-closure feature may be included, e.g., at rear platform pivot axis 216. The soft-closure feature may include, for example, one or more dampers, one or more springs, or the like to assist in the opening and closing of platform assembly 200. Additionally or alternatively, the soft-closure feature may provide movement assist during the rotation. For example, the soft-closure feature may reduce an amount of torque required to rotate or pivot platform assembly 200 between the closed position and the open position.

Platform assembly 200 may include a latch mechanism, e.g., at a top of rear platform support structure 206. The latch mechanism may selectively couple platform base 214 to rear platform support structure 206 (e.g., when platform assembly 200 is in the closed position). The latch mechanism may be a quick release latch mechanism, allowing a user to easily decouple platform base 214 from rear platform support structure 206.

An articulating platform assembly which may be selectively coupled to a home appliance, such as a washing machine appliance, is described herein. According to the description, the platform assembly may include a bracket. The bracket may be coupled to the home appliance at a lower or bottom area thereof. The bracket may be formed as two separate brackets attached to support legs of the appliance. The platform assembly may include a rear platform support structure. For instance, the rear platform support structure may include a pair of rear platform legs. The rear platform legs may be selectively coupled to the bracket (or brackets). The rear platform legs may extend generally along the vertical direction V. A cross member may be provided between the rear platform legs. A platform base may be rotatably connected to the rear platform legs so as to rotate or pivot with respect to the rear platform legs. A front platform support structure may be rotatably connected to the platform base. The front platform support structure may selectively rotate as the platform base is rotated, to extend a pair of front platform legs to support the platform assembly. A bar, such as a linkage bar, may attach the rear platform support structure with the front platform support structure. Thus, the platform assembly may be rotatable between an open position and a closed position. In the closed position, the platform assembly may be streamlined up against a face of the home appliance, thus being out of the way of users while remaining easily accessible.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A domestic appliance defining a vertical direction, a lateral direction, and a transverse direction, the domestic appliance comprising:

a cabinet defining a receiving space, the cabinet comprising a floor;

a bracket selectively coupled to the cabinet; and an articulating platform assembly selectively coupled to the cabinet, the articulating platform assembly being movable between an open position and a closed position, wherein the articulating platform assembly comprises:

a platform base;

a rear platform support structure attached to each of the platform base and the bracket, wherein the platform base pivots with respect to the rear platform support structure;

a front platform support structure pivotally attached to the platform base opposite the rear platform support structure, the front platform support structure being movable between a first position and a second position; and a cabinet support structure extending from the floor, the cabinet support structure comprising a pair of front cabinet legs, wherein the pair of front cabinet legs penetrate through the bracket and wherein the bracket comprises:

a first bracket attached to a first front cabinet leg of the pair of front cabinet legs; and a second bracket attached to a second front cabinet leg of the pair of front cabinet legs.

2. The domestic appliance of claim 1, wherein the rear platform support structure comprises:

a pair of rear platform legs spaced apart along the lateral direction; and a lateral cross member connecting the pair of rear platform legs, wherein each of the pair of rear platform legs are attached to the bracket.

3. The domestic appliance of claim 1, wherein the platform base is rotatably connected to the rear platform support structure along a platform pivot axis.

4. The domestic appliance of claim 3, wherein the front platform support structure comprises a pair of front platform legs pivotally attached to the platform base.

5. The domestic appliance of claim 4, further comprising:

a bar pivotally coupled to the rear platform support structure and the front platform support structure, wherein when the articulating platform assembly is rotated from the open position to the closed position, the bar rotates the front platform support structure from the first position to the second position.

6. The domestic appliance of claim 5, wherein the bar pivots about a bar pivot axis with respect to the rear platform support structure, the bar pivot axis being provided below the platform pivot axis of the platform base with respect to the rear platform support structure.

7. The domestic appliance of claim 1, wherein the platform base comprises:

a frame member; and a plurality of slats arranged within the frame member, each of the plurality of slats extending between a front and a rear of the frame member, wherein the rear platform support structure is attached to an outer edge of the frame member and the front platform support structure is attached to an inner edge of the frame member.

8. The domestic appliance of claim 1, wherein the domestic appliance is a washing machine appliance.

9. An articulating platform assembly for a home appliance, the home appliance defining a vertical direction, a lateral direction, and a transverse direction and comprising a cabinet, the articulating platform assembly comprising:

a bracket selectively coupled to the cabinet;

a rear platform support structure extending from the bracket along the vertical direction;

a platform base rotatably coupled to the rear platform support structure, wherein the platform base pivots with respect to the rear platform support structure between an open position and a closed position; and a front platform support structure pivotally attached to the platform base opposite the rear platform support structure, the front platform support structure being movable between a first position and a second position; and a bar pivotally coupled to the rear platform support structure and the front platform support structure, wherein when the platform base is rotated from the open position to the closed position, the bar rotates the front platform support structure from the first position to the second position.

10. The articulating platform assembly of claim 9, wherein the cabinet comprises a pair of front cabinet legs, and wherein the pair of front cabinet legs penetrate through the bracket.

11. The articulating platform assembly of claim 10, wherein the bracket comprises a first bracket attached to a first front cabinet leg of the pair of front cabinet legs and a second bracket attached to a second front cabinet leg of the pair of front cabinet legs.

12. The articulating platform assembly of claim 10, wherein the rear platform support structure comprises:

a pair of rear platform legs spaced apart along the lateral direction; and a lateral cross member connecting the pair of rear platform legs, wherein each of the pair of rear platform legs are attached to the bracket.

13. The articulating platform assembly of claim 9, wherein the platform base is rotatably connected to the rear platform support structure along a platform pivot axis.

14. The articulating platform assembly of claim 13, wherein the front platform support structure comprises a pair of front platform legs pivotally attached to the platform base.

15. The articulating platform assembly of claim 14, wherein the bar rotates about a bar pivot axis with respect to the rear platform support structure, the bar pivot axis being provided below the platform pivot axis of the platform base with respect to the rear platform support structure.

16. The articulating platform assembly of claim 9, wherein the platform base comprises:

a frame member; and a plurality of slats arranged within the frame member, each of the plurality of slats extending between a front and a rear of the frame member, wherein the rear platform support structure is attached to an outer edge of the frame member and the front platform support structure is attached to an inner edge of the frame member.

17. The articulating platform assembly of claim 9, wherein the home appliance is a washing machine appliance.

* * * * *